US007823344B2

(12) United States Patent
Shin

(10) Patent No.: US 7,823,344 B2
(45) Date of Patent: Nov. 2, 2010

(54) APPARATUS AND METHOD FOR RELEASING TENSION MEMBERS FOR USE IN ANCHOR METHOD

(75) Inventor: Jong-Duck Shin, Kyunggi-Do (KR)

(73) Assignee: Daeyoung PC. Co., Ltd, Gyeonggi-do (KR)

( * ) Notice: Subject to any disclaimer, the term of this patent is extended or adjusted under 35 U.S.C. 154(b) by 1609 days.

(21) Appl. No.: 10/493,681

(22) PCT Filed: Dec. 27, 2002

(86) PCT No.: PCT/KR02/02448

§ 371 (c)(1),
(2), (4) Date: Nov. 4, 2004

(87) PCT Pub. No.: WO2004/005627

PCT Pub. Date: Jan. 15, 2004

(65) Prior Publication Data

US 2005/0050817 A1 Mar. 10, 2005

(30) Foreign Application Priority Data

Jul. 4, 2002 (KR) ..... 10-2002-0038749
Aug. 6, 2002 (KR) ..... 10-2002-0046408
Aug. 21, 2002 (KR) ..... 10-2002-0049583

(51) Int. Cl.
*E04C 5/08* (2006.01)

(52) U.S. Cl. ..... 52/223.13; 52/741.11; 403/369

(58) Field of Classification Search ..... 52/223.13, 52/223.14, 741.11; 405/224, 225, 244; 403/368, 403/369, 374.1
See application file for complete search history.

(56) References Cited

U.S. PATENT DOCUMENTS 2,984,881 A * 5/1961 Greer ..... 403/16
3,163,904 A * 1/1965 Ziolkowski ..... 403/365
3,703,748 A * 11/1972 Kelly ..... 403/368
3,956,797 A * 5/1976 Brandestini et al. ..... 52/223.13
4,884,377 A * 12/1989 Matt ..... 52/98
4,899,499 A * 2/1990 Hoekstra ..... 52/146
5,347,777 A * 9/1994 Sudduth ..... 52/223.13

(Continued)

FOREIGN PATENT DOCUMENTS

DE 3615163 A1 * 11/1986

(Continued)

*Primary Examiner*—Brian E Glessner
*Assistant Examiner*—Adriana Figueroa
(74) *Attorney, Agent, or Firm*—The Webb Law Firm

(57) ABSTRACT

A tension member for use in an anchor method, in which both ends of the tension member are held by anchors, is released by cutting all or some of the wires in the tension member and then hitting at least one of the cut wires to release the tension member. The anchor includes an anchor head having a wedge-receiving space, a wedge unit seated in the wedge-receiving space, and three wedges assembled together to form a hole at the center of the wedge unit, through which the tension member is inserted. A support plate is inserted into a groove formed at an upper portion of the first hole and an O-shaped ring is provided around the wedges so that the wedges are expanded around the support plate. A spring is positioned on the wedge unit for constantly biasing the wedge unit against the wedge-receiving space.

9 Claims, 10 Drawing Sheets

U.S. PATENT DOCUMENTS

| | | | | |
|---|---|---|---|---|
| 5,730,556 | A | 3/1998 | Barley | |
| 6,098,361 | A | 8/2000 | Roten et al. | |
| 6,470,636 | B1 * | 10/2002 | Rose | 52/223.1 |
| 6,631,596 | B1 * | 10/2003 | Sorkin | 52/223.13 |

FOREIGN PATENT DOCUMENTS

| | | | |
|---|---|---|---|
| EP | 0816570 | A2 | 1/1998 |
| KR | 2020010242474 | Y1 | 10/2001 |
| WO | WO 03100177 | A1 * | 12/2003 |

* cited by examiner

APPARATUS AND METHOD FOR RELEASING TENSION MEMBERS FOR USE IN ANCHOR METHOD

BACKGROUND OF THE INVENTION

1. Field of the Invention

The present invention relates to an apparatus and method for releasing tension members for use in an anchor method to provide soft ground reinforcement for civil engineering projects, and more particularly, to an apparatus and method for releasing tension members for use in an anchor method, in which both ends of the tension member are firmly and stably held by anchors, where all or some of the wires are cut, and at least one end of the cut wires is hit to release the tension member.

2. Description of Related Art

Generally, an anchor method is used to reinforce soft ground by drilling a hole into the ground, inserting an anchor member composed of a grout-feeding hose and a tension member into the drilled hole, pouring grout into the anchor member through the grout-feeding hose, curing the grout with the anchor member, fastening an anchor with one end of the tension member, and drawing the tension member by use of tensioning equipment to apply tension to the grout and the ground. Such an anchor method is mainly used for land-side protection wall construction, stone setting works, retaining wall construction, etc.

The application of the anchor method offers advantages of increased effectiveness in managing downtown construction, reduction in the required duration of projects, etc. Upon carrying out further construction in an adjacent region, drilling and boring machinery is required and the duration of projects is lengthened due to the embedding of tension members with strength six times stronger than that of common steel reinforcements. In order to solve the above problem, an anchor for removing the tension member after the completion of the drilling construction has been developed, and it is referred to as a tension member-releasing apparatus for use in an anchor method.

Several tension member-releasing apparatuses for use in the anchor method have been proposed. For example, one tension member-releasing apparatus for use in an anchor method is disclosed in Korean Utility Model Publication No. 20-0242474. In this Utility Model, the apparatus includes a body formed with a threaded portion for fastening a cap on an outer surface of an upper end thereof and which has a wedge-receiving space; a wedge assembly mounted in the wedge-receiving space of the body, which has an external ring mounted on a groove formed on the outer surface of the wedge assembly for maintaining an assembled state thereof and which is radially expanded by an internal ring mounted on an inner groove, and in which a spoiler is inserted into a spoiler groove formed at a front portion of the inner groove; a locking member for seating the spoiler containing a resilient hook to the spoiler groove of the wedge assembly; and the cap having a protrusion which is fastened to the upper portion of the body and receives a resilient hook.

According to the method for releasing the tension member by use of the tension member-releasing apparatus described above, if the tension member installed in the ground in a tensioning state is cut, then the tension member is moved toward the embedded anchor by means of repulsive force resulting from the release of tension in the tension member. At that time, the tension member and the wedge assembly mounted to the end of the tension member are moved into the wedges, and thus the wedges are expanded, thereby allowing the front end of the tension member to be released from the wedges.

The locking member assembled to the wedge assembly is also moved together with the tension member, and the resilient hook of the locking member is inserted and fixed to the protrusion of the cap. After the resilient hook of the locking member is fixed to the protrusion of the cap, all wedges of the wedge assembly are expanded to release the locking of the tension member. Therefore, the tension member may be drawn by pulling the tension member.

If the tension member is not released due to a weak repulsive force, the cut end of the tension member is hit by a hammer so that the tension member is moved toward the anchor, thereby causing the resilient hook of the locking member to abut against the protrusion.

According to the conventional tension member-releasing apparatus disclosed in the publication, if external shock is applied to the wedge assembly with the tension assembled thereto due to carelessness, necessity or some other reason, the tension member is inserted and thus the resilient hook of the locking member mounted on the upper end of the wedge assembly is locked by the protrusion of the cap. When this occurs, it is impossible to release the tension member from the wedge assembly. Therefore, a problem results in that the wedge assembly may not be reused because all wedges of the wedge assembly have become expanded.

In addition, a significant amount of force is required to hit the tension member so that the resilient hook of the locking member will become abutted against the protrusion of the cap. Also, another potential problem exists in that the hammer can miss the tension member due to carelessness.

SUMMARY OF THE INVENTION

Therefore, an object of the present invention is to solve the problems involved in the prior art, and to provide an apparatus for releasing tension members for use in an anchor method, which includes an anchor fastened to the tension member and a release for disassembling the tension member fastened to the anchor, which prevents release of the tension member due to an accidental external shock. The fastening or release of the tension member to the anchor may be repeated several times.

Another object of the present invention is to provide an apparatus for releasing tension members for use in an anchor method, in which a support plate used in a wedge unit of the anchor is formed to have a cap-shaped cross section, so that the end of the tension member may be held more firmly and stably.

Further, another object of the present invention is to provide an apparatus for releasing tension members for use in an anchor method, in which all or some of the wires of the tension member, are cut, and at least one cut wire is hit and driven toward the anchor so that after releasing the tension member from the wedge unit of the anchor, the tension member may be pulled out and removed.

In order to accomplish the above mentioned objects, there is provided an apparatus for releasing the tension member. The apparatus includes an anchor fastened to one end of a tension member, and a release mounted to the other end of the tension member. The anchor includes an anchor head having opened upper and lower ends, and being formed with a cone-shape wedge-receiving space at the upper end of the anchor head; a wedge unit seated in the wedge-receiving space of the anchor head. The wedge unit has three wedges assembled together to form a first hole at a center portion of the wedge unit, through which the tension member is inserted. A support plate is inserted into a circular groove formed at an upper portion of the first hole, and an O-shaped ring is provided around three wedges so that the wedges are expanded around the support plate. A spring is positioned on an upper portion of the wedge unit for constantly biasing the wedge unit against the wedge-receiving space of the anchor head. A wedge cover is fastened to the anchor head, with the spring being seated on the upper end of the anchor head.

The support plate includes a support plate of a cap-shaped cross section to stably and firmly hold the tension member inserted into the first hole of the wedge unit.

According to another aspect of the present invention, there is provided an apparatus for releasing tension member that includes a ground anchor fastened to one end of a tension member. The tension member also includes a release, mounted to the other end of the tension member for fastening and releasing the tension member, after releasing tension by cutting the other end of the tension member that is external to the ground. The tension member is installed in the ground with tension and fastened to the anchor.

The release includes an extended pipe-type release head having a second hole for receiving the tension member, which consists of a wire having several strands (e.g., seven strands) laid together with a uniform pitch. The upper end of the release head is formed with a male thread, and a release cover is fastened to the pipe-type release head by engaging the male thread of the release head with a female thread formed at a lower end of a third hole of the release cover. The third hole of the release cover is provided at an inner surface thereof with a protrusion for engaging at least one wire of the tension member. A locking bolt is fastened to a front end of the release head to selectively lock the tension member.

The release is provided by assembling the release head and the release cover, but the release head and the release cover may be integrally formed.

According to still another aspect of the present invention, there is provided a method for releasing tension members for use in an anchor method. The method includes the steps of: cutting at least one of a plurality of wires forming a tension member, which is installed with one end in a ground surface together with an anchor and the other end fastened to another anchor, the tension member being applied with tension; hitting at least one of the cut wires of the tension member toward the anchor installed in the ground to remove the remaining wires from the wedge unit; repeating the hitting step so that an outer diameter of the tension member is abruptly decreased and thus the tension member is released from the wedge unit when the displaced wires of the tension member leave one end of the wedge unit; and withdrawing the released tension member.

It is to be understood that both the foregoing general description and the following detailed description of the present invention are exemplary and explanatory and are intended to provide further explanation of the present invention as claimed.

BRIEF DESCRIPTION OF THE DRAWINGS

The above objects, other features and advantages of the present invention will become more apparent by describing the preferred embodiment thereof with reference to the accompanying drawings, in which.

DETAILED DESCRIPTION OF THE INVENTION

Reference will now be made in detail to the preferred embodiments of the present invention, examples of which are illustrated in the accompanying drawings.

An apparatus for releasing tension members for use in an anchor method according to the present invention will now be described with reference to the accompanying drawings.

Figure 1:
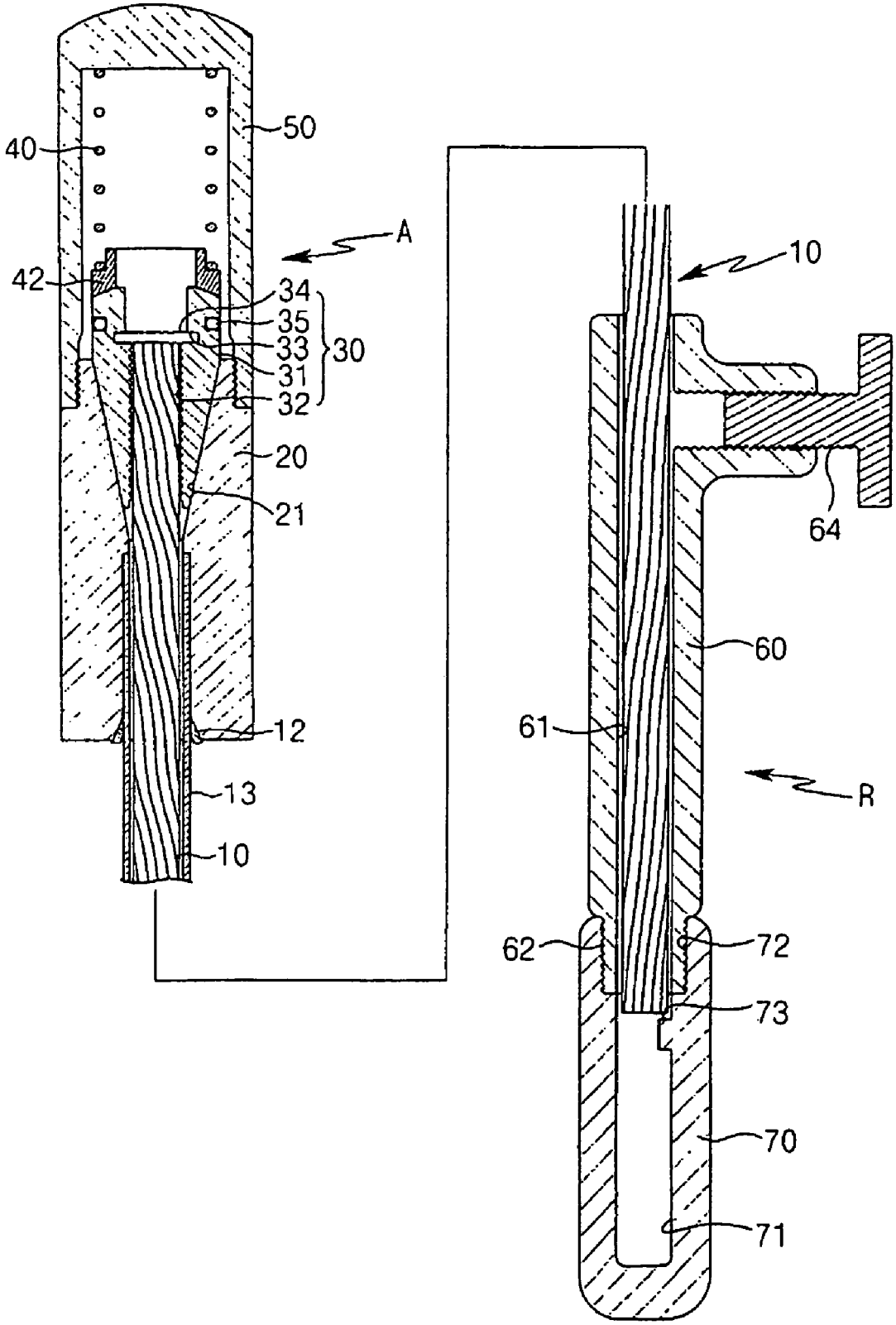
FIG. 1 is a cross-sectional view showing a tension member-releasing apparatus according to one preferred embodiment of the present invention.
Figure 2:
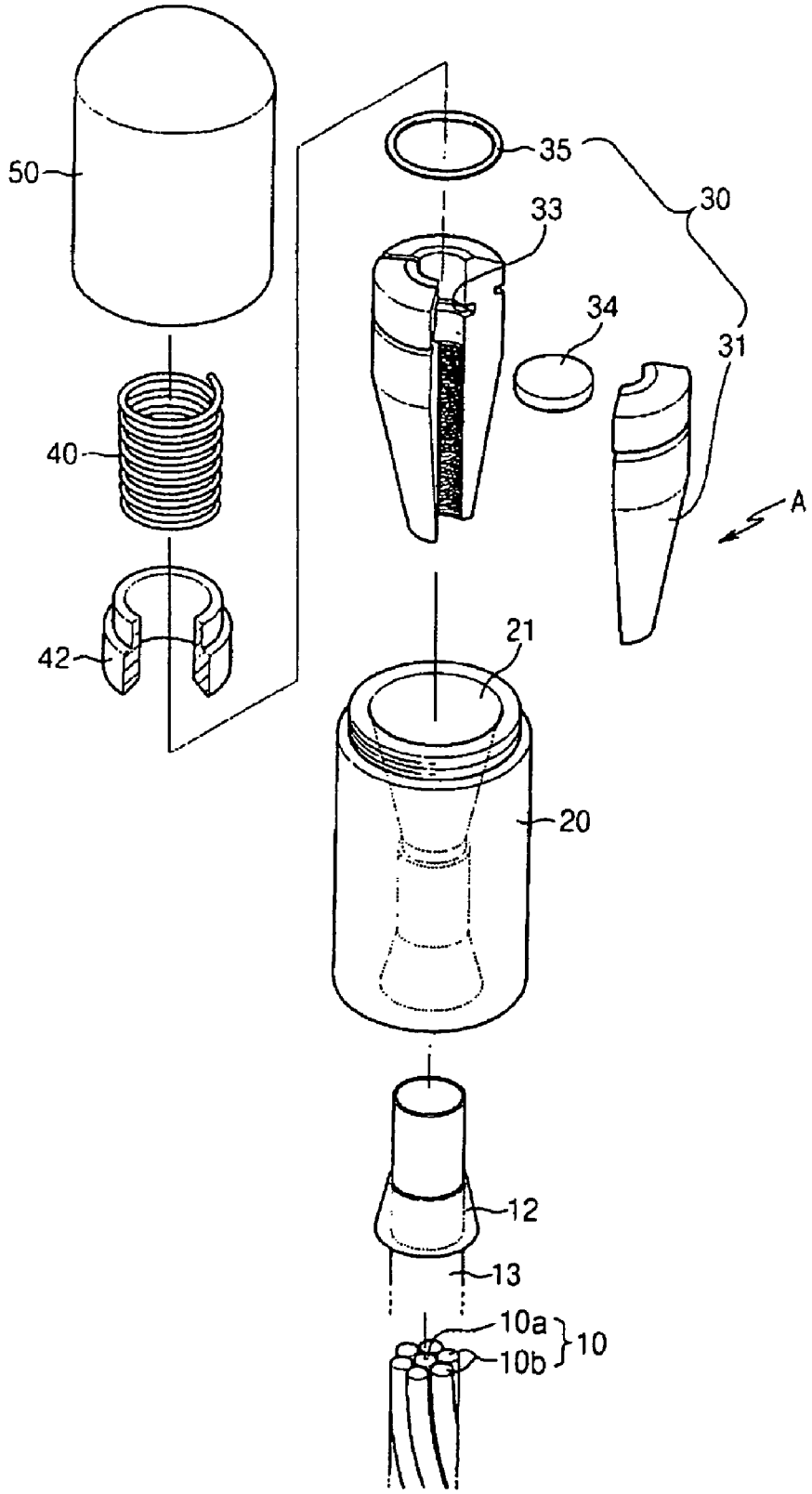
FIG. 2 is an exploded perspective view of the anchor shown in FIG. 1.
Figure 3:
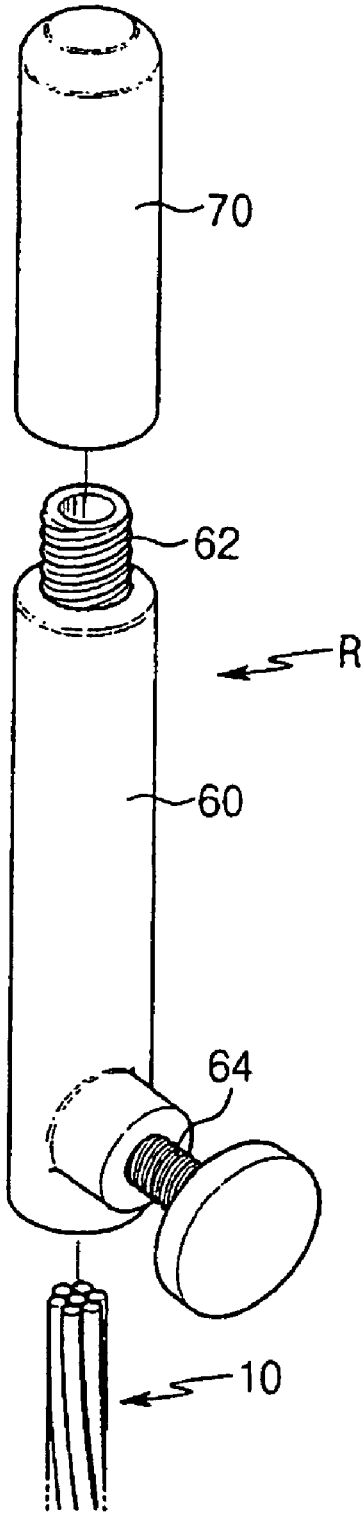
FIG. 3 is an exploded view of the release shown in FIG. 1.

FIG. 1 is a cross-sectional view showing a tension member-releasing apparatus for use in the anchor method according to one preferred embodiment of the present invention. FIG. 2 is an exploded perspective view of the anchor shown in FIG. 1. FIG. 3 is an exploded view of the release shown in FIG. 1.

As shown in the figures, the tension member-releasing apparatus for use in the anchor method includes an anchor A fastened to one end of a tension member 10, which is inserted into the ground, and a release R, which is mounted to the other end of the tension member 10, which is external to the ground, and is used for fastening and releasing the tension member 10.

The tension member 10 includes a wire of seven strands consisting of 6 strands 10*b* laid together around a center strand 10*a* with a uniform pitch.

The anchor A includes a wedge cover 50 used to resiliently support a wedge unit 30 against an anchor head 20 by means of a spring 40. The anchor head 20 has opened upper and lower ends, and a cone-shape wedge-receiving space 21 is formed at an upper portion of the anchor head 20. The wedge unit 30 is seated in the wedge-receiving space 21 of the anchor head 20. The anchor head 20 is provided on a lower portion thereof with a plastic tube 12 such that an airtight state may be maintained when the tension member 10 is inserted into the anchor head 20. The tube 12 functions as a waterproof member for preventing water from permeating into the inside of the anchor A, thereby protecting against corrosion.

The wedge unit 30 includes three wedges 31 assembled together to form a first hole 32 at the center portion of the wedge unit through which the tension member 10 is inserted. A support plate 34 is inserted into a circular groove 33 formed at the upper portion of the first hole 32, and an O-shaped ring 35 is provided around three wedges 31 so that the wedges may be expanded around the support plate 34. An inner surface of the first hole 32 of the wedge unit 30 is formed with a helical or indented recess, thereby preventing the tension member 10 from sliding or leaving the wedge unit 30 when the tension member 10 is pulled.

The wedge unit 30 includes a compressive cover 42 to allow smooth motion of the respective wedges 31; a spring 40 for constantly biasing the compressive cover 42 and the wedge unit 30 to the wedge-receiving space 21 of the anchor head 20; and a wedge cover 50 fastened to the anchor head 20 with the spring 40 located on the upper end of the anchor head 20.

The reason why the wedge unit 30 is tightened by the compressive cover 42 is that the upper surface of the wedge unit 30 and the lower surface of the compressive cover 42 are formed to share the same inclined angle (generally, 30 degrees) in a radial outward direction, and thus the wedge unit 30 is constantly pressed toward the center. Also, the lower surface of the compressive cover 42 may be formed to have an incline with an angle larger than that of the upper surface of the wedge unit 30 by about 15 degrees.

The release R includes an extended pipe-type release head 60, which has a second hole 61 for receiving the tension member 10. The tension member 10 consists of a wire of seven strands 10*a* and 10*b* laid together with a uniform pitch. The upper end of the release head is formed with a male thread 62. A release cover 70 is fastened to the release head 60 by engaging the male thread 62 of the release head 60 with a female thread 72 formed at a lower end of a third hole 71 of the release cover 70, through which the tension member 10 passes. A protrusion 73 for engaging two or more adjacent wires 10*b* is provided on an inner surface of the third hole 71 of the release cover. A locking bolt 64 is fastened to a front end of the release head 60 to selectively lock the tension member 10.

The release head 60 and the release cover 70 are fastened to each other by a male thread 62 and a female thread 72, but the release head 60 and the release cover 70 may be integrally formed.

Figure 5A:
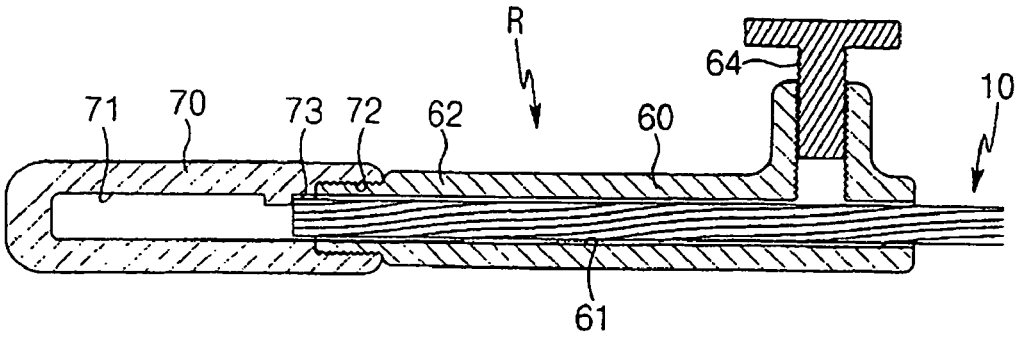
FIGS. 5*a* to 5*e* are cross-sectional views depicting the process wherein wires of tension member are pushed from a release head and the tension member is released from the anchor according to the present invention.
Figure 5B:
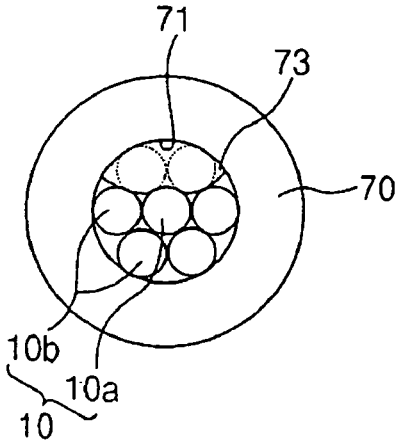

The protrusion 73, as shown in FIG. 5*b*, is formed to engage two or more wires adjacent to an edge of the tension member 10, but the protrusion 73 may be formed differently according to the arrangement of the wires (10*a*, 10*b*). For example, the protrusion 73 may be formed to engage the center wire, surrounding wire or other wires.

A releasing process of the tension member will now be described in detail with reference to the tension member-releasing apparatus for the anchor method.

Figure 4A:
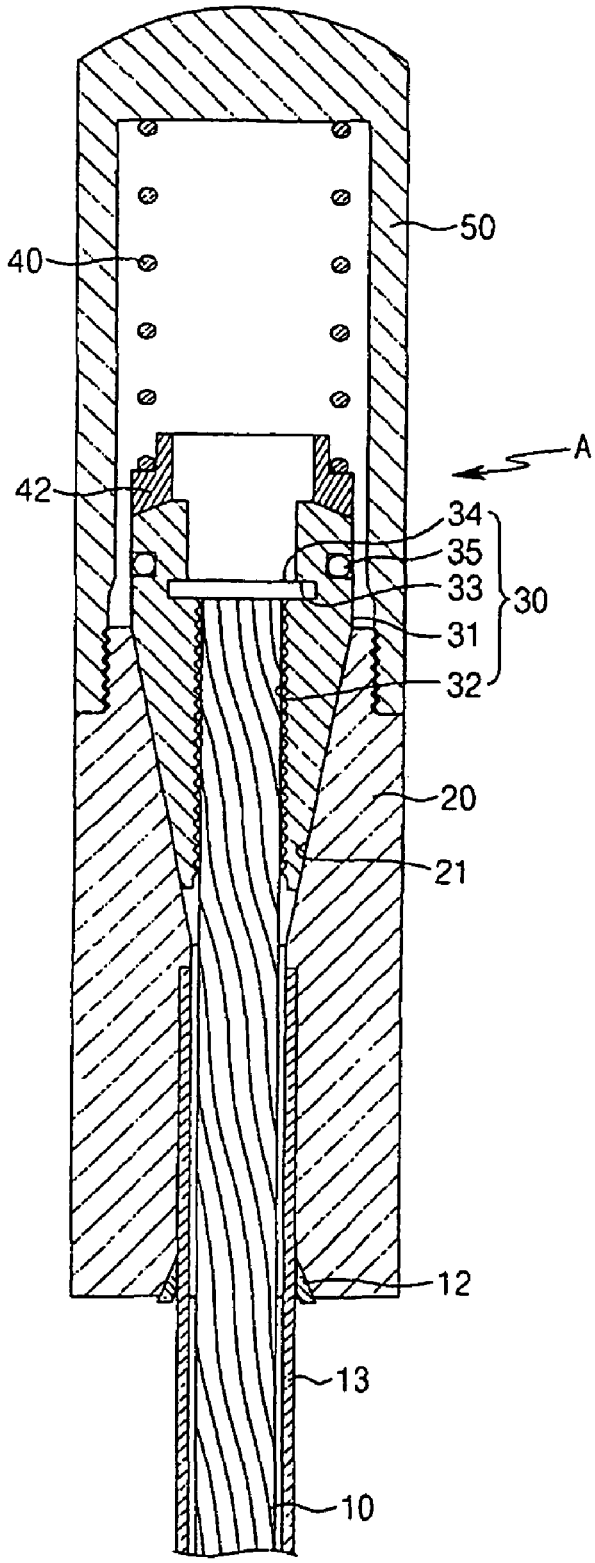
FIG. 4*a* is a cross-sectional view depicting the state in which a tension member is fixed to an anchor according to the present invention.

As shown in FIGS. 1 and 4*a*; after the anchor A is fastened to one end of the tension member 10 and an anchor member consisting of the tension member 10 and a grout-feeding hose 13 is inserted into a ground hole drilled by a drill, grout is poured through the grout-feeding hose 13 and is then cured. When the curing of the poured grout is completed, another anchor A is fastened to the other end of the tension member 10, and the tension member 10 is pulled by means of a tensioner so as to apply maximum tension to the tension member 10 and the grout.

When the outwardly pulled portion of the tension member 10 is cut, the tension applied to the tension member 10 is released. Simultaneously, the tension member 10 and the wedge unit 30 positioned at the end of the tension member 10 are moved toward the installed anchor A against the resilience of the spring 40 by the repulsive force that is generated by cutting the tension member 10. Since the repulsive force of the tension member 10 is completely absorbed at the time that the repulsive force is equal to the resilience of the spring 40, the tension member 10 is returned to the wedge-receiving space 21 of the anchor head 20 by the biasing force of the spring 40. At that time, the tension member 10 is retained within the anchor A, as it is held by the wedge unit 30 of the anchor A.

When the cut end of the tension member 10 is inserted into the second hole 61 formed in the release head 60 of the release R, the end of the tension member 10 passes through the second hole 61 of the release head 60 and is positioned at the lower end of the protrusion 73 formed in the third hole 71 of the release cover 70. At that time, the protrusion 73 formed on the inner surface of the third hole 71 of the release cover 70 engages two adjacent wires 10*b* that form the tension member 10, as shown in FIGS. 5*a* and 5*b*.

Figure 5C:
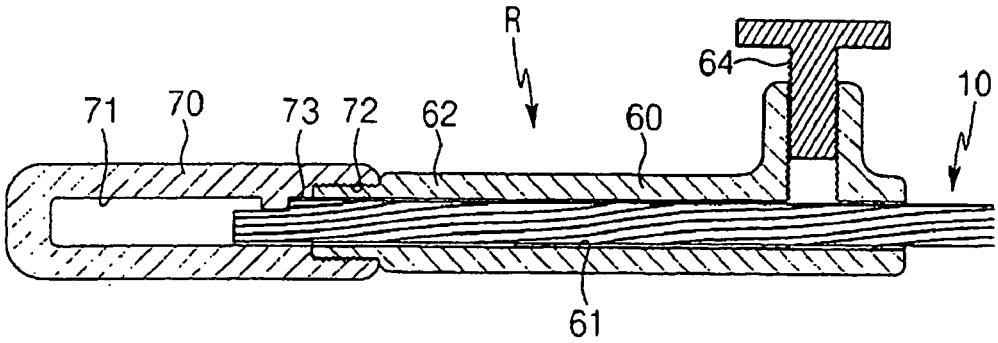
Figure 5D:
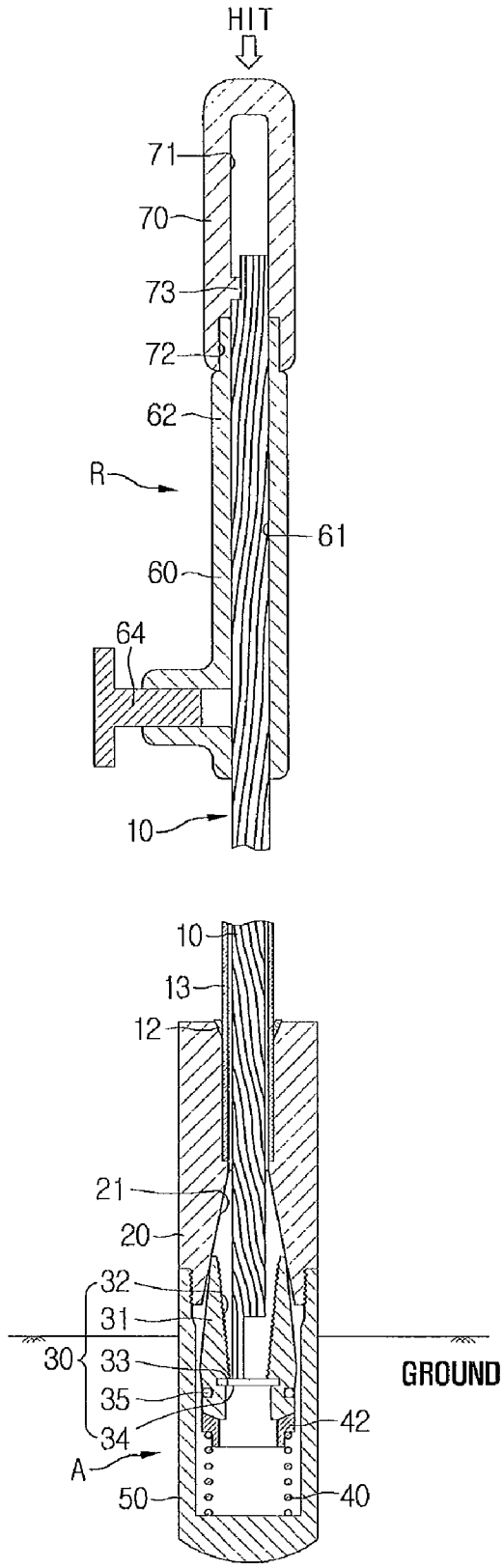

Then, when the end of the release cover 70 is hit by a hammer, the two adjacent wires 10*b* among the wires 10*a* and 10*b* that form the tension member 10 are driven toward the anchor A by means of the protrusion 73 formed on the inner surface of the third hole 71 of the release cover 70, as shown in FIG. 5*c* and FIG. 5*d*.

Figure 4B:
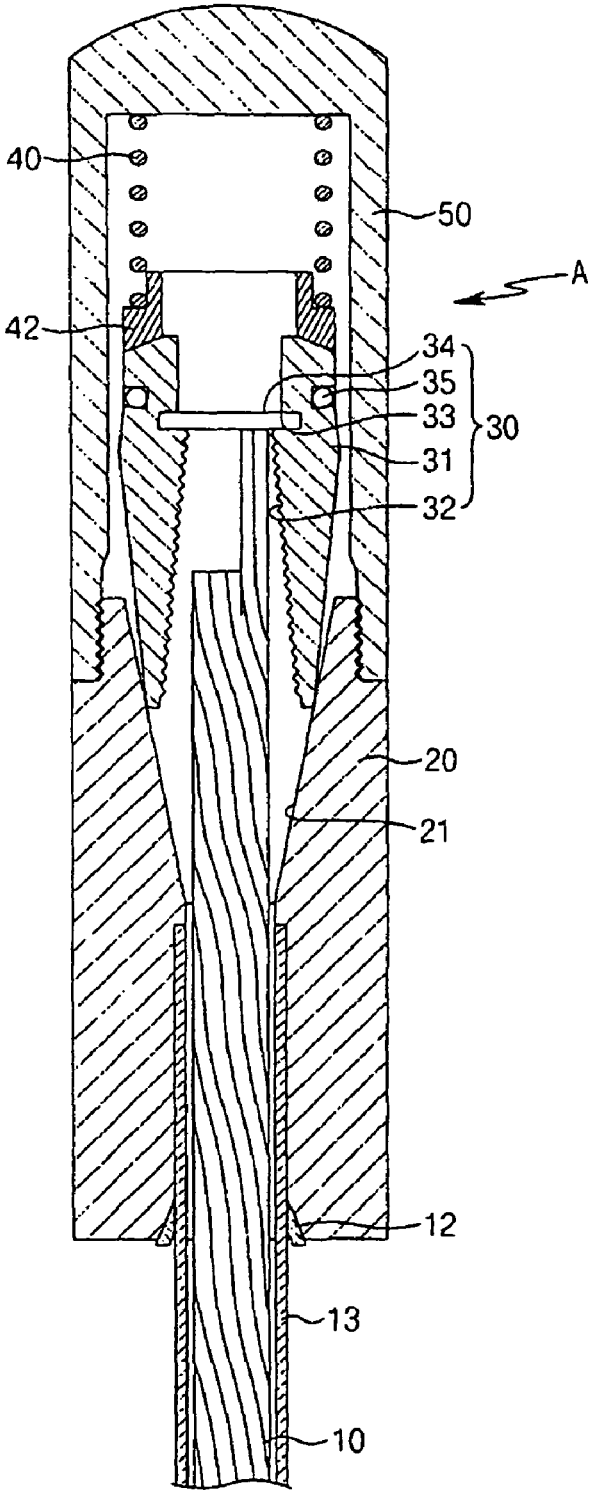
FIG. 4*b* is a cross-sectional view depicting the process where a wedge unit is pushed by wires of a tension member.

The wedge unit 30 pushes the support plate 34 of the wedge unit 30 against the wedge cover 50 by a distance of the two wires 10*b*, as shown in FIG. 4*b*, and then is returned to the original position by the biasing force of the spring 40, as shown in FIG. 4*a*.

In other words, the wedge-receiving space 21 of the anchor head 20 is outwardly expanded by an allowable range defined by the O-shaped ring 35 provided at the outer surface of the wedge unit 30 and by the pushed distance of the wedge unit 30 when the two wires 10*b* forming the tension member 10 pushes the wedge unit 30. At that time, the remaining wires 10*a* and 10*b* of the tension member 10 are pushed into the release R hitting the tension member 10.

When the external force hitting the release R is completely absorbed, the wedge unit 30 is pushed into the wedge-receiving space 21 of the anchor head 20 by the biasing force of the spring 40, such that the wedges 31 of the wedge unit 30 are radially contracted. At that time, the outer surface of the tension member 10 comes into contact with the inner surface of the wedges 31 of the wedge unit 30.

As described above, two wires 10*b* of the tension member 10 are inserted into the anchor A installed in the ground by repeatedly hitting the release R, and thus the remaining wires 10*a* and 10*b* of the tension member 10 that are not hit are pushed in a direction opposite to the direction of the hit. At the moment that the relatively moved wires 10*a* and 10*b* of the tension member 10 leave the end of the wedge 31 opposite the support plate 34 of the wedge unit 30, the outer diameter of the tension member 10 is abruptly decreased. Therefore, the tension member 10 is released from the wedge 31 of the wedge unit 30.

Specifically, even though the wedges 31 of the wedge unit 30 are contracted, some wires 10*b* forming the tension member 10 are not fastened because they are less than the diameter of the first hole 32 of the wedge unit 30.

Figure 5E:
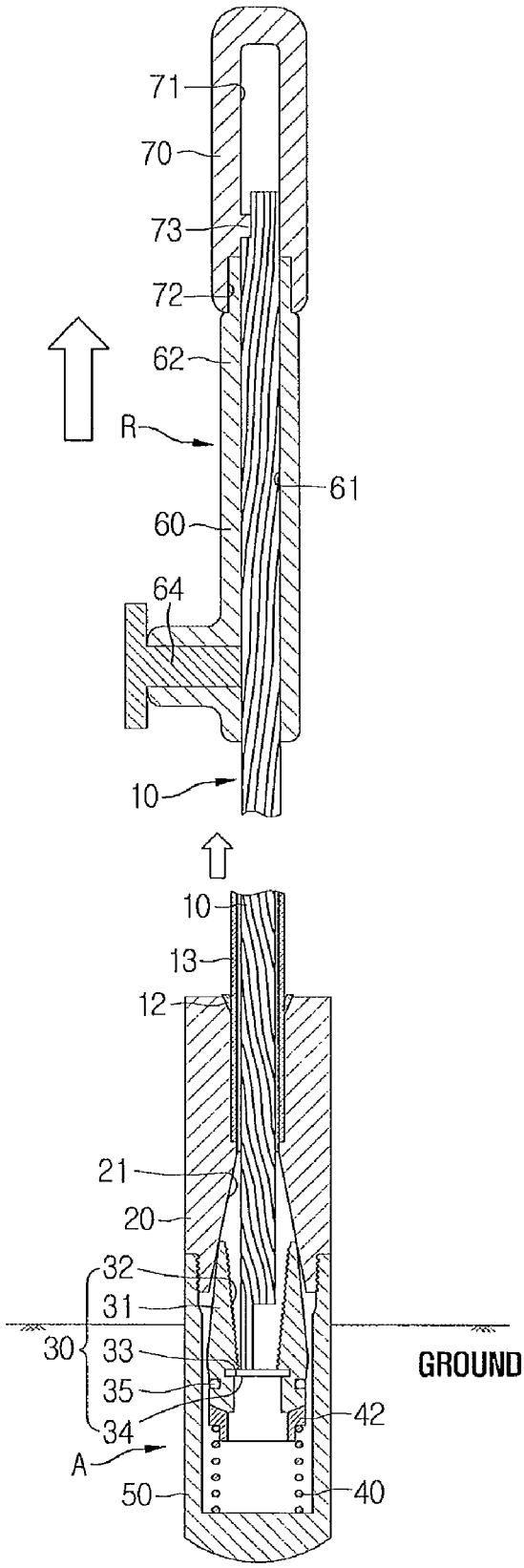

If the tension member 10 is released from the wedge unit 30 of the anchor A, the tension member 10 is retained within the hole by its own weight and slight frictional resistance only. As shown in FIG. 5*e*, after tightening the locking bolt 64 of the release head 60, the tension member 10 is extracted and removed by pulling the release R.

The releasing method described above is carried out by cutting all of tension member 10 and drawing out the tension member 10 from the anchor A installed in the ground, but another method may be carried out by cutting only wire 10*b*, or wires 10*a* and 10*b*, among the tension member 10 and hitting at least one wire 10*b* between the cut wires 10*a* and 10*b* with a separate hand tool.

Figure 6:
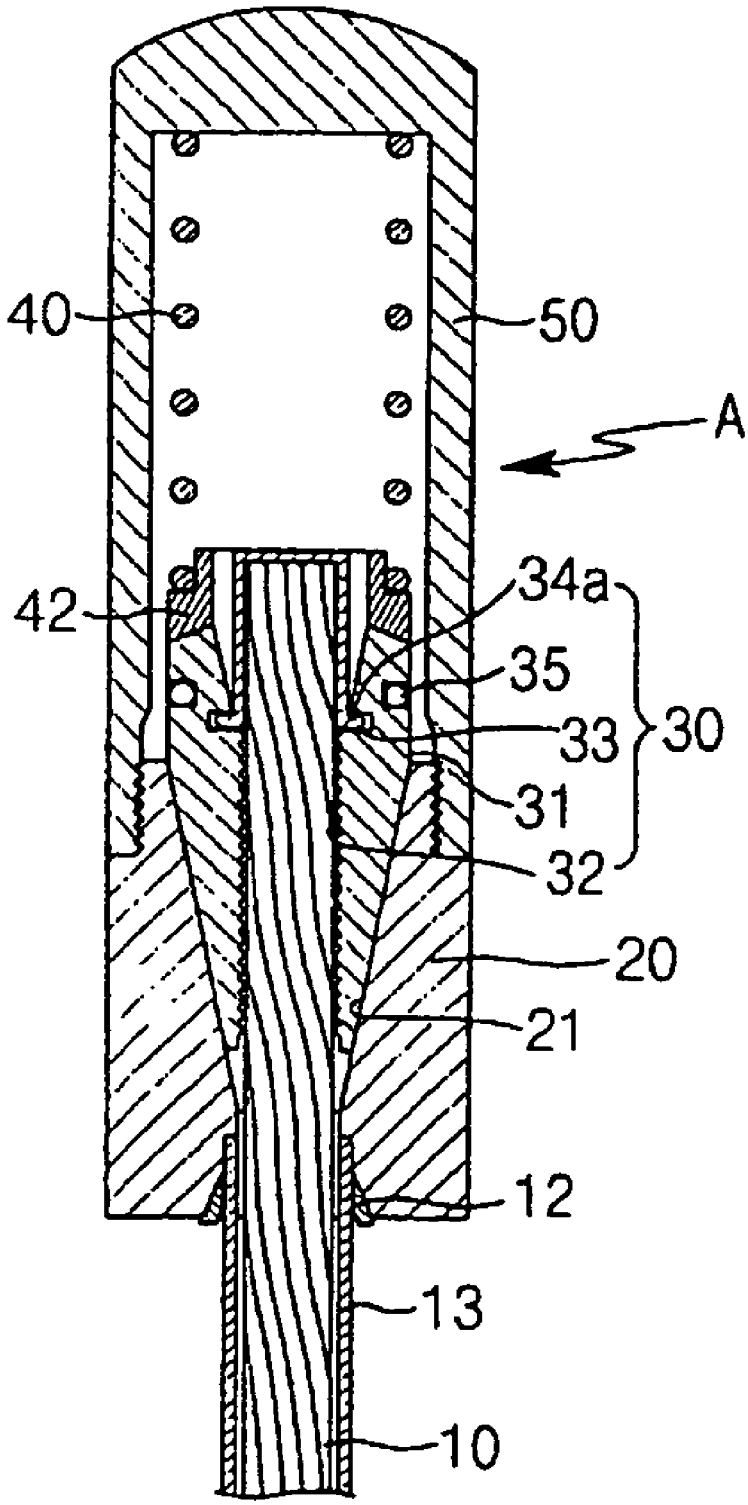
FIGS. 6 and 7 are cross-sectional views depicting an anchor according to another embodiment of the present invention.

FIG. 6 depicts a support plate of a wedge unit 30 for an anchor A according to another embodiment of the present invention, which is substantially similar to the above embodiment except that a support plate 34*a* is formed with a cap-shaped cross section and has a flange around an external lower end thereof.

In this embodiment, if the support plate 34*a* is formed to have the cap-shaped cross section, the tension member 10 is pushed upwardly into the first hole 32 of the wedge unit 30. If the tension member 10 is deeply inserted upward, the end of the tension member 10 that is not held by the wedge 31 of the wedge unit 30 is radially expanded. Therefore, the flange of the support plate 34*a* is supported, thereby stably and firmly holding the tension member.

Figure 7:
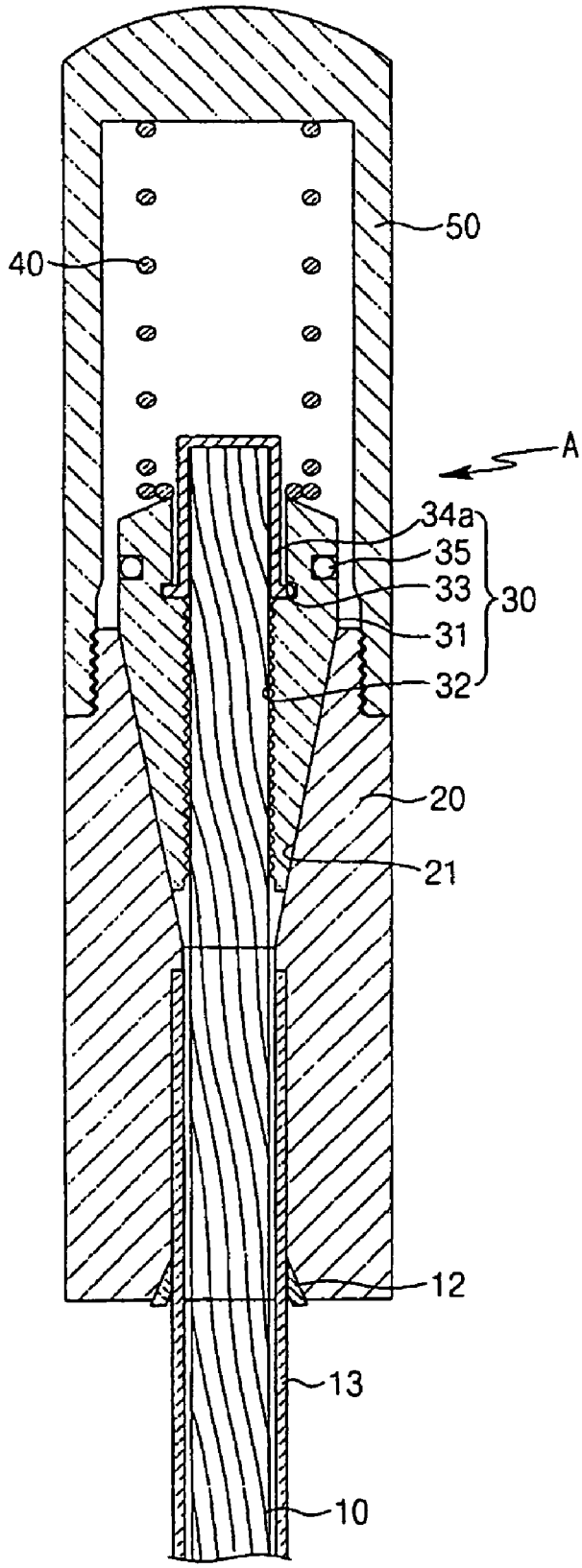

FIG. 7 is a view showing an anchor A according to another embodiment of the present invention, in which the support plate 34*a*, which has the cap-shaped cross section assembled to an upper portion of the wedge 31 of the wedge unit 30, protrudes beyond the upper end of the wedge 31. In this case, a lower end portion of a spring 40 abuts against the upper surface of the wedge 31 and is formed to have a diameter smaller than that of an upper portion thereof, so that the spring encloses a circumference of the support plate 34*a* protruding from the upper portion of the wedge 31. This embodiment does not require a compressive cover 42, thereby reducing the number of components and decreasing the cost.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers all modifications and variations of this invention that come within the scope of the appended claims and their equivalents.

INDUSTRIAL APPLICABILITY

In the above description, when the tension member-releasing apparatus for the anchor method according to the present invention removes the tension member installed in the ground, the process avoids the problems of rust or strong repulsive force, which are common reasons that tension member removal fails. In addition, upon carrying or working the tension member that has an end mounted to the anchor, the release of the tension member due to external shock is prevented. Moreover, the fastening or release of the tension member to the anchor may be repeated several times.

Since the support plate used in the wedge unit of the anchor is formed to have a cap-shaped cross section, the end of the tension member may be held more firmly and stably. In the event that the spring's lower end has a diameter less than that of the upper end thereof, the compressive cover is not required, thereby reducing the number of components, and thus decreasing the cost.

Furthermore, all or some of the wires consisting of several strands, i.e., the tension member to which tension is applied by the anchors positioned at both ends of the wire, are cut, and at least one cut wire is hit and inserted towards the anchor. The remaining wires that are not hit are relatively displaced out of the wedge unit. The diameter of the tension member is abruptly decreased at the moment that the wire leaves the end of the wedge unit. Therefore, after releasing the fastening of the tension member from the wedge unit of the anchor, the tension member may be pulled out and removed.

The invention claimed is:

1. An apparatus for releasing a tension member, including an anchor fastened to one end of the tension member and a release mounted to the other end of the tension member, said tension member being comprised of a plurality of wires laid together with a uniform pitch, the anchor comprising:

an anchor head having open upper and lower ends and a cone-shape wedge-receiving space formed at the upper end of the anchor head;

a wedge unit seated in the wedge-receiving space of the anchor head, the wedge unit having three wedges assembled together to form a first hole at a center portion of the wedge unit, through which the tension member is inserted, a support plate inserted into a circular groove formed at an upper portion of the first hole, and an O-shaped ring provided around the three wedges so that the wedges are expanded around the support plate;

a spring positioned on an upper portion of the wedge unit for constantly biasing the wedge unit against the wedge-receiving space of the anchor head; and a wedge cover fastened to the anchor head, with the spring being seated on the upper end of the anchor head, and the release comprising:

an extended pipe-type release head having a second hole for receiving the other end of the tension member;

a release cover fastened to the release head and configured to be hit by a hammer at a position opposite to a position where the release cover is fastened to the release head, said release cover having a third hole for receiving a part of the tension member; and a protrusion protruded from an inner surface of the third hole in a direction perpendicular to the inner surface of the third hole, said protrusion attached to at least one of the wires of the tension member at the other end of the tension member so that at least one of the wires is pushed by the protrusion toward the anchor when the hammer hits the release cover.

2. The apparatus as claimed in claim 1, wherein a compressive cover for allowing smooth motion of the respective wedges is interposed between the spring and the wedge unit.

3. The apparatus as claimed in claim 2, wherein the support plate includes a support plate having a cap-shaped cross section to stably and firmly hold the tension member inserted into the first hole of the wedge unit.

4. The apparatus as claimed in claim 3, wherein the support plate protrudes beyond an upper end of the wedge unit and a lower end portion of the spring, abutted against an upper surface of the wedge, and has a diameter smaller than that of an upper portion of the spring.

5. The apparatus as claimed in claim 1, wherein the release head and the release cover are integrally formed.

6. A method for releasing a tension member of an anchor apparatus including an anchor fastened to one end of the tension member and a release mounted to the other end of the tension member, the tension member being comprised of a plurality of wires, said release comprising a release head having a second hole for receiving the other end of the tension member, a release cover fastened to the release head and configured to be hit by a hammer at a position opposite to a position where the release cover is fastened to the release head, said release cover having a third hole for receiving a part of the tension member, and a protrusion protruded from an inner surface of the third hole in a direction perpendicular to the inner surface of the third hole, said protrusion attached to at least one of the wires of the tension member at the other end of the tension member so that at least one of the wires is pushed by the protrusion toward the anchor when the hammer hits the release cover, the method comprising the steps of:

cutting at least one of the wires of the tension member, wherein one end of the tension member is installed in ground together with the anchor and the other end of the tension member is fastened to another anchor;

fastening a cut end of the tension member to the release;

hitting the release cover so that the protrusion pushes at least one of the cut wires of the tension member toward the anchor installed in the ground to push the remaining wires from the anchor toward the release;

repeating the hitting step so that an outer diameter of the tension member is abruptly decreased and thus the tension member is released from the anchor at a moment that the remaining wires of the tension member leave the anchor;

locking the tension member by using a locking bolt provided to the release; and drawing the released tension member by pulling the release.

7. The method as claimed in claim 6, wherein in the cutting step, all of the wires of the tension member are cut.

8. The apparatus as claimed in claim 1, wherein the support plate has a cap-shaped cross section to stably and firmly hold the tension member inserted into the first hole of the wedge unit, the support plate protrudes beyond an upper end of the wedge of the wedge unit and a lower end portion of the spring, and the support plate has an inner space into which the tension member is extended.

9. The apparatus as claimed in claim 1, wherein the release further includes a locking bolt fastened to the release to selectively lock the tension member.

* * * * *